United States Patent [19]

Nieder

[11] Patent Number: 4,506,924

[45] Date of Patent: Mar. 26, 1985

[54] ROCK LIFTING DEVICE

[76] Inventor: Charles E. Nieder, 17519 Lyons Valley Rd., Jamul, Calif. 92035

[21] Appl. No.: 429,105

[22] Filed: Sep. 30, 1982

[51] Int. Cl.[3] ..... B66C 1/66

[52] U.S. Cl. ..... 294/89; 294/96

[58] Field of Search ..... 294/89, 96, 86.25, 94; 52/699, 701, 704, 122, 125

[56] References Cited

U.S. PATENT DOCUMENTS 884,198 4/1908 Neddo ..... 294/89

2,719,747 10/1955 Layne ..... 294/89

*Primary Examiner*—James B. Marbert

*Attorney, Agent, or Firm*—Charles C. Logan, II

[57] ABSTRACT

A rock lifting device having an elongated shaft and at least two feather members. A pair of wedge surfaces are formed on the outer surface of the shaft adjacent its bottom end. The top end of each of the wedge surfaces is located farther inwardly from the outer surface of the shaft than its bottom end of the wedge surface. The wedge surfaces are substantially planar. Each of the feather members has a shank portion, an arm member extending outwardly from its top end, and a wedge portion extending from the bottom end of the shank portion. The wedge portion has a wedge surface upon its inner face. The wedge surfaces of the feather members mate with the wedge surfaces of the shaft. A transversely extending bore hole passes through the top of the shaft and a clevis attached to a chain may be secured thereto. There is also structure for securing the feather members to the shaft.

8 Claims, 10 Drawing Figures

105
106
101
99
100
102
110
105
106
101
103

87
85
86
92
110

85
87
88
42
43
86
92
90
X - AXIS
42
43
93
89
90
110

42
43
40
24
46
45
49
48

ROCK LIFTING DEVICE

BACKGROUND OF THE INVENTION

The invention relates to a rock lifting device having a wide range of applications. It is capable of being used not only with a crane, but can also be used with backhoes and other earth excavating equipment.

In the past it has been necessary to break large rocks up into small pieces before they could be lifted in the bucket of earth moving equipment. This has been quite costly in terms of man hours and equipment necessary to break the rocks into such small sizes.

It is an object of the invention to provide a novel rock lifting device that can be utilized quickly by merely drilling a hole into the rock, after which the rock lifting device is inserted and the rock can then be lifted upwardly.

It is also an object of the invention to provide a novel rock lifting device that is economical to manufacture and assemble.

It is another object of the invention to provide a novel rock lifting device that can be marketed at a reasonable price.

It is an additional object of the invention to provide a novel rock lifting device that will prevent much unnecessary breaking of rocks into smaller sizes in order to have them moved.

It is an additional object of the invention to provide a novel rock lifting device that will be easily adaptable for use with many earth moving pieces of equipment.

SUMMARY OF THE INVENTION

Applicant's novel rock lifting device has an elongated shaft having a longitudinally extending axis. The top end of the shaft has a transversely extending bore hole through which clevis attached to a chain may be secured. A pair of wedge surfaces are formed on the outer surface of the shaft adjacent its bottom end. The top end of each of these wedge surfaces is located further inwardly from the outer surface of the shaft than its bottom end of the wedge surface. These wedge surfaces are substantially planar.

The rock lifting device has at least two feather members, each of which has a shank portion, an arm member extending outwardly from its top end, and a wedge portion extending from the bottom end of the shank portion. The wedge portion has a wedge surface upon its inner face. The wedge surfaces of the feather members mate with the wedge surfaces of the shaft. The device also has structure for securing the feather members to the shaft.

DESCRIPTION OF THE PREFERRED EMBODIMENT

Figure 5:
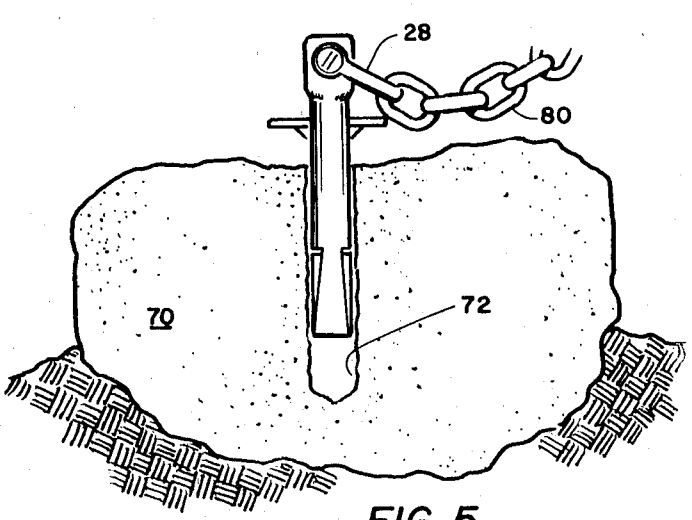
FIG. 5 is a schematic illustration of the novel rock lifting device as it is inserted into the bore hole driven into a rock.

Applicant's novel rock lifting device will be described by referring to FIGS. 1–5 of the drawings. The rock lifting device is generally designated numeral 20. It has an elongated shaft 22 and a pair of feather members 24.

Shaft 22 has a generally cylindrical shape with a head portion 26 formed at its top. A bore hole 27 extends transversely through head portion 26 and provides structure for attaching a clevis 28 thereto.

The bottom end of shaft 22 has diametrically opposed outer wedge surfaces 32 and 33.

The feather members 24 have a shank portion 40 with an arm 42 attached at its top and reinforced by brace member 43. The bottom end of shank portion 40 has a wedge portion 45 formed thereon which has a top wall 46 and a wedge surface 48. An elongated slot 49 extends a major portion of the length of shank portion 40.

A groove 55 extends along a major portion of shaft 22 and it provides a track for shank portion 40 to travel along. Feather member 24 is captured in channel 55 and secured to the shaft 22 by a rivet 60 that is captured in a bore hole 61 that passes entirely through the diameter of shaft 22.

Figure 6:
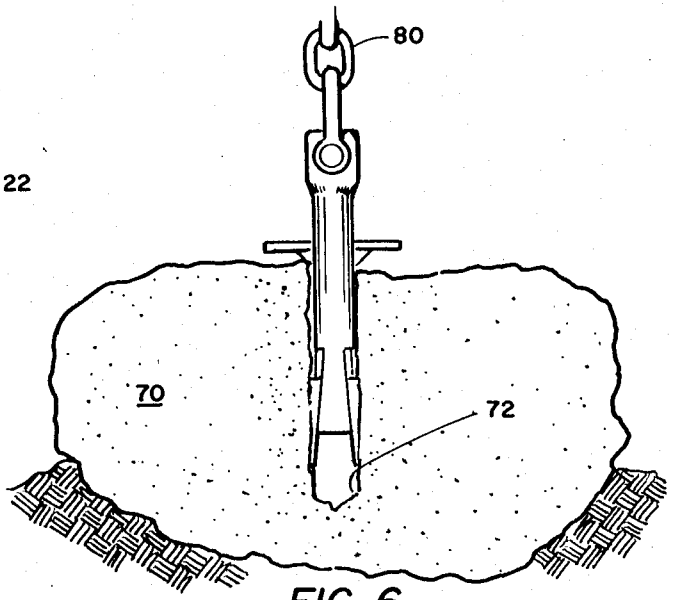
FIG. 6 is a schematic illustration showing the novel rock lifting device as it is wedged into the bore hole of a rock and is about to lifted.
Figure 3:
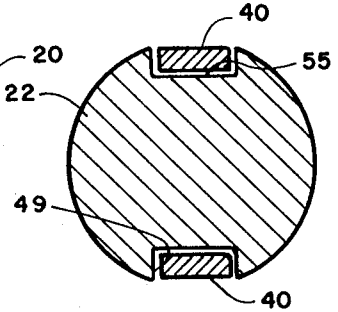
FIG. 3 is a cross-sectional view taken along lines 3—3 of FIG. 1.
Figure 4:
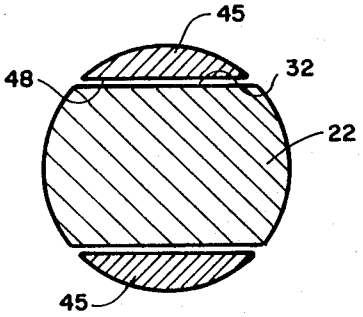
FIG. 4 is a cross-sectional view taken along lines 4—4 of FIG. 1.
Figure 2:
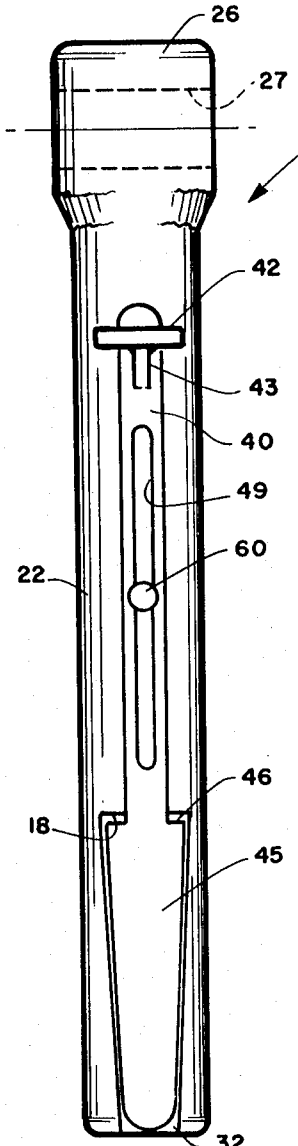
FIG. 2 is a side elevation view of the novel rock lifting device.
Figure 1:
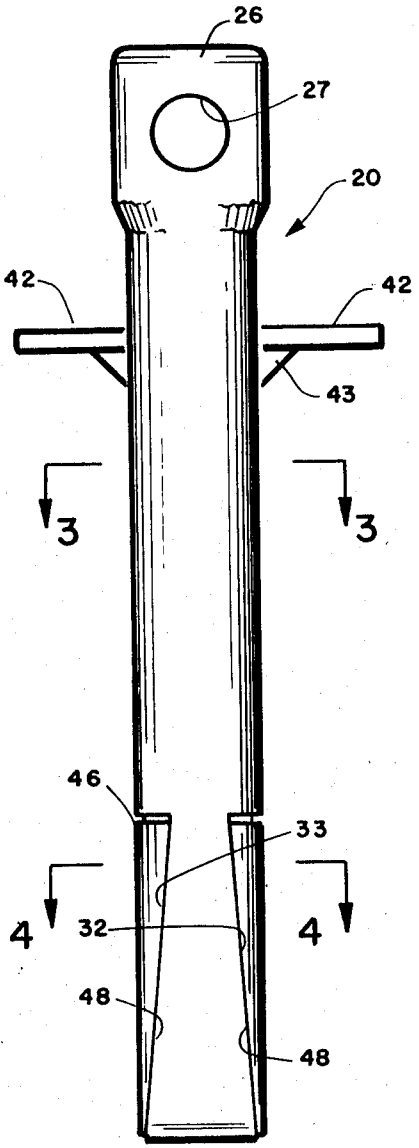
FIG. 1 is a front elevation view of the novel rock lifting device.

In FIGS. 5 and 6, one manner in which the rock lifting device is used is illustrated. A rock 70 has a bore hole 72 drilled in its top surface approximately 14 inches deep. The rock lifting device 20 is then partially inserted into that bore hole 72 and arms 42 of the feather members are forced downwardly causing the wedge surfaces 48 of the feather members to travel downwardly across the wedge surfaces 32 and 33 of the shaft member 22. This produces a wedging action of the rock lifting device against the side walls of bore hole 72.

Another manner of utilizing the novel rock lifting device is to drop it into the bore hole having a diameter approximately ⅛ of an inch greater than that of the diameter of the shaft 22. The device will drop downwardly until arms 42 have been brought into contact with the top of the rock. The worker now stands with his feet on arms 42 and as chain 80 is lifted directly overhead the shaft portion 22 will be drawn upwardly causing a wedging action between the wedge surfaces of the respective members. This wedging force is so great that the rock may be lifted upwardly without any further attachments made thereto and the more the shaft 22 attempts to come out of the bore hole 72, the tighter will the grip of the novel rock lifting device.

Figures 7, 8, 9, 10:
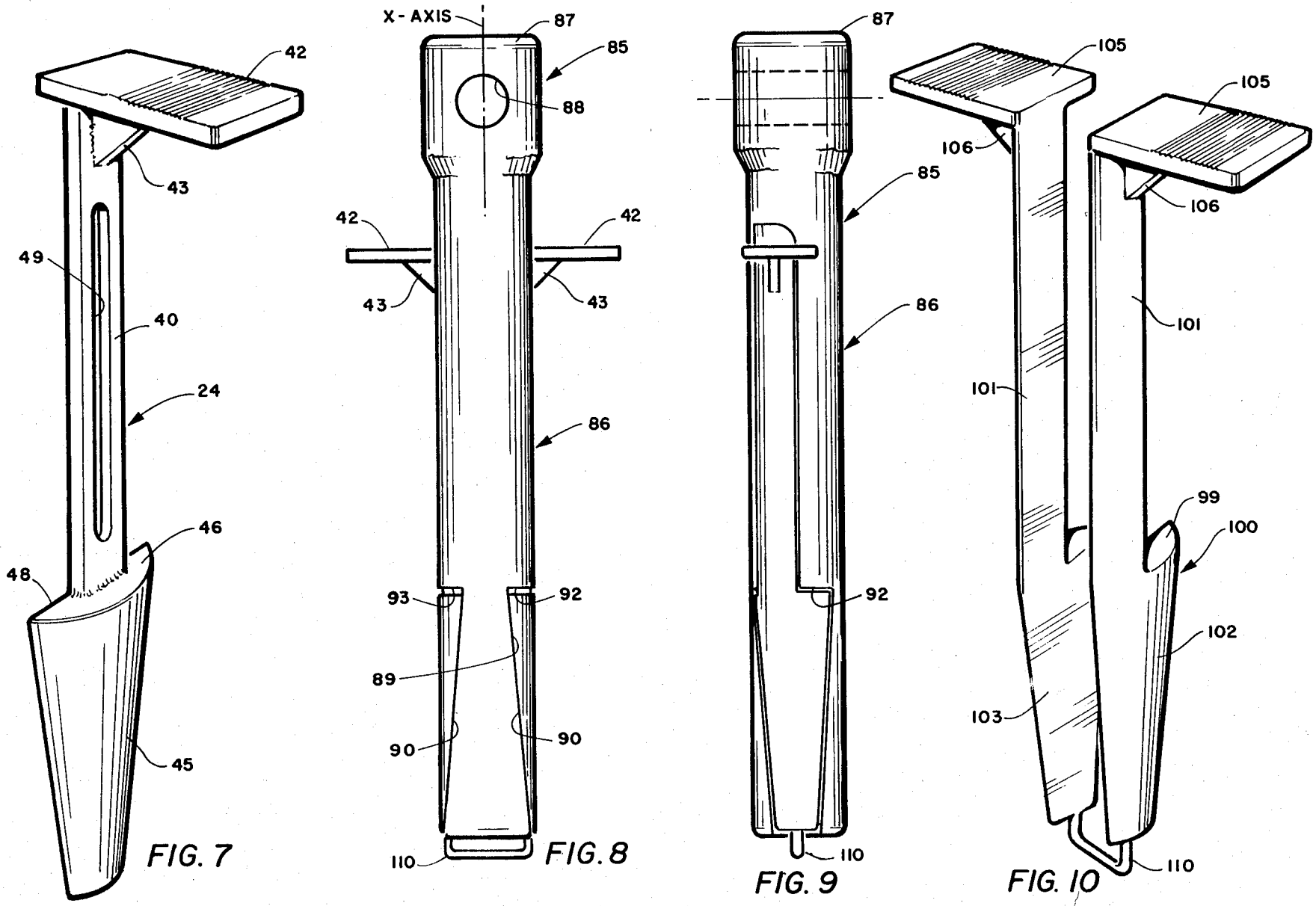
FIG. 7 is a perspective view of the novel feather member of the rock lifting device.
FIG. 8 is a front elevation view of an alternative novel rock lifting device.
FIG. 9 is a side elevation view of the alternative novel rock lifting device.
FIG. 10 is a perspective view of the feather member assembly of the alternative novel rock lifting device.

An alternative novel rock lifting device 85 is illustrated in FIGS. 8–10. It has a shaft 86, having an x-axis. Its head portion 87 has a transversely extending bore hole 88. The bottom end of shaft 86 has wedge surfaces 89 and 90. It also has a shoulder 92 and 93 at the upper edge of wedge surfaces 89 and 90 respectively.

Its feather member 100 has shank portions 101, and wedge portions 102 which have inner wedge surfaces 103. The top end of shank portion 101 has an outwardly extending arm 105 reinforced by a brace member 106. A U-shaped spring member 110 attaches the bottom ends of the wedge portions 102 together. The alternative novel rock lifting device operates in the same manner as the previously described rock lifting device.

What is claimed is:

1. A rock lifting device comprising:

an elongated shaft having a longitudinally extending axis;

a pair of wedge surfaces formed on the outer surface of said shaft adjacent its bottom end, said pair of wedge surfaces being substantially diametrically opposed to each other, the top end of each of said wedge surfaces being located farther inwardly from the outer surface of said shaft than its bottom end of said wedge surface, said wedge surfaces being substantially planar;

at least two feather members, each feather member having a shank portion, an arm member extending outwardly from its top end, and a wedge portion extending from the bottom end of said shank portion, said wedge portion having a substantially planar wedge surface upon its inner face;

the sum of degrees of each set of mating wedge surfaces is substantially 90 degrees; and means adjacent the top end of said shaft for attaching a lifting device thereto.

2. A rock lifting device as recited in claim 1 wherein said means for attaching a lifting device to the top end of the shaft comprises a transversely extending bore hole through which a clevis attached to a chain can be secured.

3. A rock lifting device as recited in claim 1 wherein the wedge surfaces of said feather members mate with said wedge surfaces of said shaft.

4. A rock lifting device as recited in claim 3 further comprising means to limit the axial travel of said shaft and said feather members toward each other.

5. A rock lifting device as recited in claim 4 wherein said axial travel limiting means are a shoulder on said shaft located at the top edge of its wedge surface and the top wall of the wedge portion of said feather member.

6. A rock lifting device as recited in claim 3 further comprising means for securing said feather members to said shaft.

7. A rock lifting device as recited in claim 6 wherein said means for securing said feather members to said shaft comprises a U-shaped spring wire having its opposite ends connected to the bottom tips of the wedge portions of said feather members.

8. A rock lifting device as recited in claim 6 wherein said means for securing said feather members to said shaft comprises: a pair of rivets, an elongated slot in the shank portion of each of said feather members, a longitudinally extending groove in the outer surface of said shaft into which the shank portion of each feather member mates, and a transversely extending bore aligned through said grooves of said shaft into which said rivets are secured.

* * * * *